US007583283B2

(12) United States Patent
Matsushita et al.

(10) Patent No.: US 7,583,283 B2
(45) Date of Patent: Sep. 1, 2009

(54) EXPOSURE APPARATUS, IMAGE FORMING APPARATUS AND HEAT ADJUSTMENT METHOD

(75) Inventors: Yukihiro Matsushita, Ebina (JP); Youji Houki, Ebina (JP); Yoshihiko Taira, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/026,610

(22) Filed: Feb. 6, 2008

(65) Prior Publication Data

US 2008/0232856 A1 Sep. 25, 2008

(30) Foreign Application Priority Data

Mar. 16, 2007 (JP) ..... 2007-069356

(51) Int. Cl.
*B41J 2/435* (2006.01)
*B41J 2/47* (2006.01)

(52) U.S. Cl. ..... 347/234; 347/229; 347/248

(58) Field of Classification Search ..... 347/116, 347/133, 236–238, 246–250, 229, 234; 341/94; 327/512

See application file for complete search history.

(56) References Cited

U.S. PATENT DOCUMENTS 5,264,848 A * 11/1993 McGuffin ..... 341/94
6,011,575 A * 1/2000 Haneda ..... 347/238
6,028,472 A * 2/2000 Nagumo ..... 327/512
6,266,074 B1 * 7/2001 Koumura et al. ..... 347/133

FOREIGN PATENT DOCUMENTS

JP 03218864 A * 9/1991
JP 03269455 A * 12/1991
JP 2002-370400 A 12/2002

* cited by examiner

*Primary Examiner*—Hai C Pham
(74) *Attorney, Agent, or Firm*—Sughrue Mion, PLLC

(57) ABSTRACT

The exposure apparatus is provided with: plural light emitting elements that are arranged in a line; a substrate that the plural light emitting elements are arranged thereon; plural temperature measuring units that are arranged along the arrangement direction of the plural light emitting elements and measure temperatures of the substrate on which the plural light emitting elements are arranged; and plural heating units that are arranged along the arrangement direction of the plural light emitting elements and heat the substrate on the basis of the temperatures measured by the temperature measuring units respectively.

11 Claims, 11 Drawing Sheets

EXPOSURE APPARATUS, IMAGE FORMING APPARATUS AND HEAT ADJUSTMENT METHOD

CROSS REFERENCE TO RELATED APPLICATIONS

This application is based on and claims priority under 35 USC §119 from Japanese Patent Application No. 2007-069356 filed Mar. 16, 2007.

BACKGROUND

1. Technical Field

The present invention relates to an exposure apparatus and the like that writes information with light in an image forming apparatus such as a printer and a copy machine, and a heat adjustment method.

2. Related Art

In a color image forming apparatus with an electrophotographic type such as a printer and a copy machine, as an exposure apparatus that is used at the time of forming color toner images, there is a known apparatus that is formed by arranging light emitting elements such as LEDs in the main scanning direction. In such an exposure apparatus, since heat is generated at the time of lighting the light emitting elements, a substrate that supports the light emitting elements elongates and retracts due to an influence of the heat. Therefore, different displacement of the light emitting elements is generated for each exposure apparatus. When the color toner images are combined, there is sometimes a case where color drift is generated.

SUMMARY

According to an aspect of the invention, there is provided an exposure apparatus including: plural light emitting elements that are arranged in a line; a substrate that the plural light emitting elements are arranged thereon; plural temperature measuring units that are arranged along the arrangement direction of the plural light emitting elements and measure temperatures of the substrate on which the plural light emitting elements are arranged; and plural heating units that are arranged along the arrangement direction of the plural light emitting elements and heat the substrate on the basis of the temperatures measured by the temperature measuring units respectively.

BRIEF DESCRIPTION OF THE DRAWINGS

Exemplary embodiment(s) of the present invention will be described in detail based on the following figures, wherein.

DETAILED DESCRIPTION

First Exemplary Embodiment

Hereinafter, with reference to the attached drawings, a detailed description is given to exemplary embodiments of the present invention.

Figure 1:
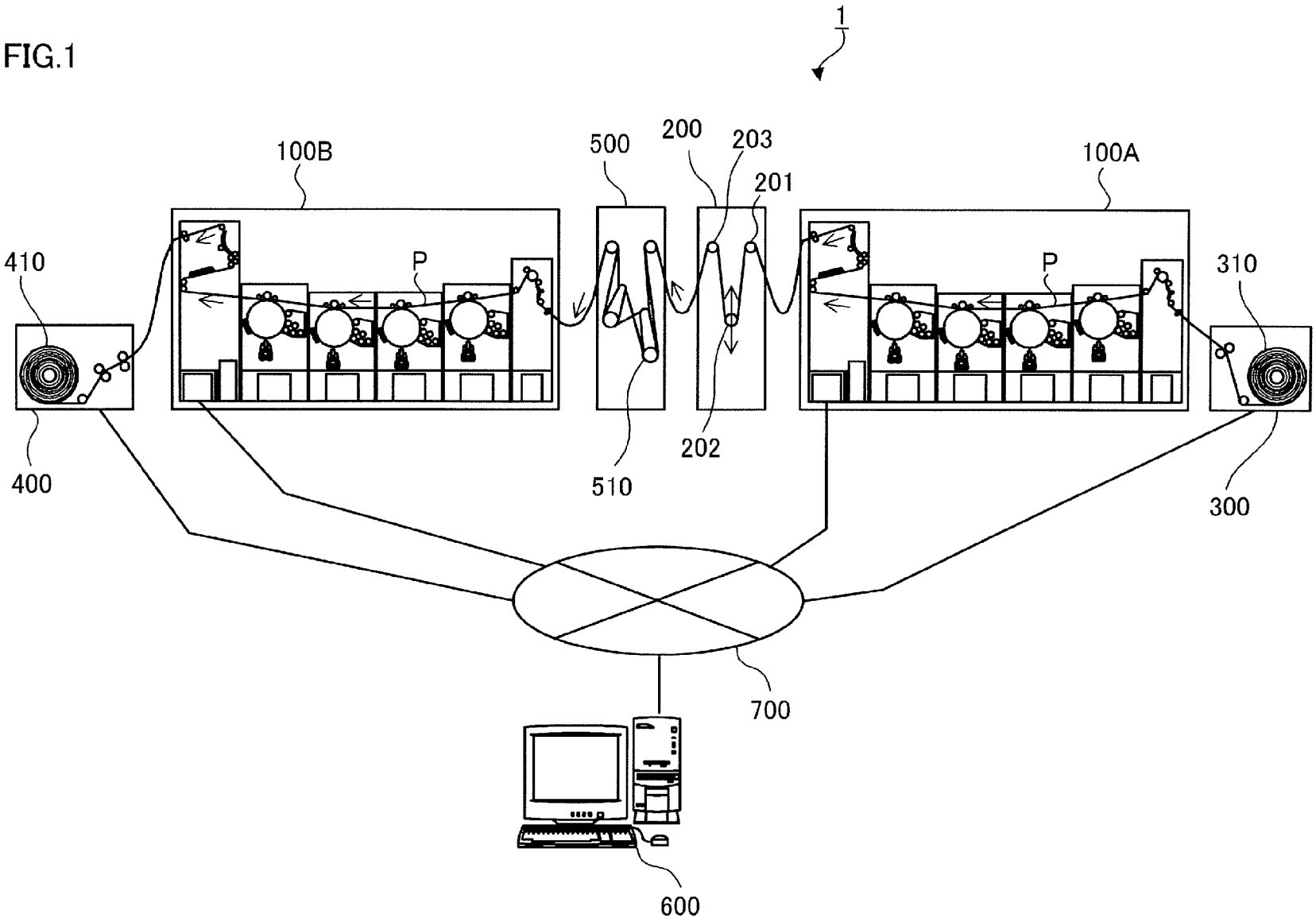
FIG. 1 is a view that shows an entire configuration of a printing system to which an image forming apparatus according to the first exemplary embodiment is applied.

FIG. 1 is a view that shows an entire configuration of a printing system 1 to which an image forming apparatus according to the first exemplary embodiment is applied. The printing system 1 shown in FIG. 1 is configured so as to use a continuous paper P that is continuously formed in a belt shape as an example of a recording medium, and forms an image on the both sides of the continuous paper P. That is, the printing system 1 according to the first exemplary embodiment is provided with, from the upstream side in the transportation direction of the continuous paper P towards the downstream side, a continuous paper supplying apparatus 300, a first printer 100A serving as an example of the image forming apparatus that is arranged on the upstream side, a buffer unit 200, a front-back reverse unit 500, a second printer 100B serving as an example of the image forming apparatus that is arranged on the downstream side, and a continuous paper winding apparatus 400.

The printing system 1 according to the first exemplary embodiment is provided with a control computer 600 that controls actions of the apparatuses configuring the printing system 1. The control computer 600 is connected to the continuous paper supplying apparatus 300, the first printer 100A, the second printer 100B, and the continuous paper winding apparatus 400 through a communication network 700.

In the continuous paper supplying apparatus 300, a continuous paper roll 310 around which the continuous paper P is wound, is installed so as to supply the continuous paper P to the first printer 100A.

The first printer 100A prints an image on a front surface of the continuous paper P that is supplied from the continuous paper supplying apparatus 300 on the basis of image data that is sent from the control computer 600.

The buffer unit 200 transports the continuous paper P of which, in the first printer 100A, a printing processing is performed on the front surface side towards the second printer 100B, while holding a predetermined amount of the continuous paper P. That is, in the buffer unit 200, as a transporting roll, an upstream side hanging roll 201, a tension roll 202 that is installed movably in, for example, the up and down direction (the arrow direction), and transports the continuous paper P while giving a predetermined tensile force to the continuous paper P, and a downstream side hanging roll 203 are arranged. The continuous paper P is successively transported from the upstream side hanging roll 201 to the downstream side hanging roll 203, through the tension roll 202 (201→202→203). As a result, a loop that is to hold a predetermined amount of the continuous paper P within the buffer unit 200 is formed in the continuous paper P.

The front-back reverse unit 500 reverses the front and the back surfaces of the continuous paper P and supplies the continuous paper P to the second printer 100B. That is, in the front-back reverse unit 500, a front-back reverse roll 501 that is arranged with inclination of 45 degrees in the transportation direction of the continuous paper P is provided. By transporting the continuous paper P while hanging the continuous paper P with the front-back reverse roll 501, the front and the back surfaces of the continuous paper P is reversed. Therefore, the transportation direction of the continuous paper P that already passes through the front-back reverse unit 500 is changed by 90 degrees. Consequently, the second printer 100B is arranged in the direction with 90 degrees displacement from the first printer 100A.

The second printer 100B is configured similarly to the first printer 100A. On a back surface of the continuous paper P of which, in the first printer 100A, the printing processing has been performed on the front surface, the image is printed on the basis of the image data that is sent from the control computer 600.

The continuous paper winding apparatus 400 winds the continuous paper P of which, in the second printer 100B, the printing processing has been performed on the back surface around a winding roll 410.

It should be noted that in the printing system 1 according to the first exemplary embodiment, the first printer 100A forms the image on the front surface of the continuous paper P, and the second printer 100B forms the image on the back surface of the continuous paper P, respectively. However, the printing system 1 may be configured such that the first printer 100A forms the image on the back surface of the continuous paper P and the second printer 100B forms the image on the front surface of the continuous paper P respectively.

The control computer 600 outputs the image data to be printed on the front surface side and the image data to be printed on the back surface side at predetermined timing to the first printer 100A and the second printer 100B respectively through the communication network 700. Moreover, the control computer 600 outputs control signals that control actions of the first printer 100A and the second printer 100B respectively.

The communication network 700 is configured so as to communicate interactively by using a communication line and a cable, or may be configured by, for example, a network such as LAN (Local Area Network), WAN (Wide Area Network) and the like.

In the printing system 1 according to the first exemplary embodiment, under the control of the control computer 600, the first printer 100A prints a full color image on the front surface side of the continuous paper P that is supplied from the continuous paper supplying apparatus 300. The continuous paper P of which, in the first printer 100A, the full color image is printed on the front surface side is transported to the buffer unit 200, and while a predetermined amount of the continuous paper P is held in the buffer unit 200, the continuous paper P is transported to the front-back reverse unit 500. The front-back reverse unit 500 reverses the front and the back surfaces of the transported continuous paper P and transports the continuous paper P to the second printer 100B.

In the second printer 100B to which the reversed continuous paper P is transported, the full color image is printed on the back surface side of the continuous paper P, while the page thereof is aligned with the image that is printed on the front surface side in the first printer 100A. Thereby, the full color images are formed on the both sides of the continuous paper P. The continuous paper P on which the printing processing has been performed in the second printer 100B is fed to the continuous paper winding apparatus 400 and wound around the winding roll 410.

Next, a description is given to the first printer 100A and the second printer 100B according to the first exemplary embodiment. In the first exemplary embodiment, the first printer 100A and the second printer 100B have the same configuration each other.

Figure 2:
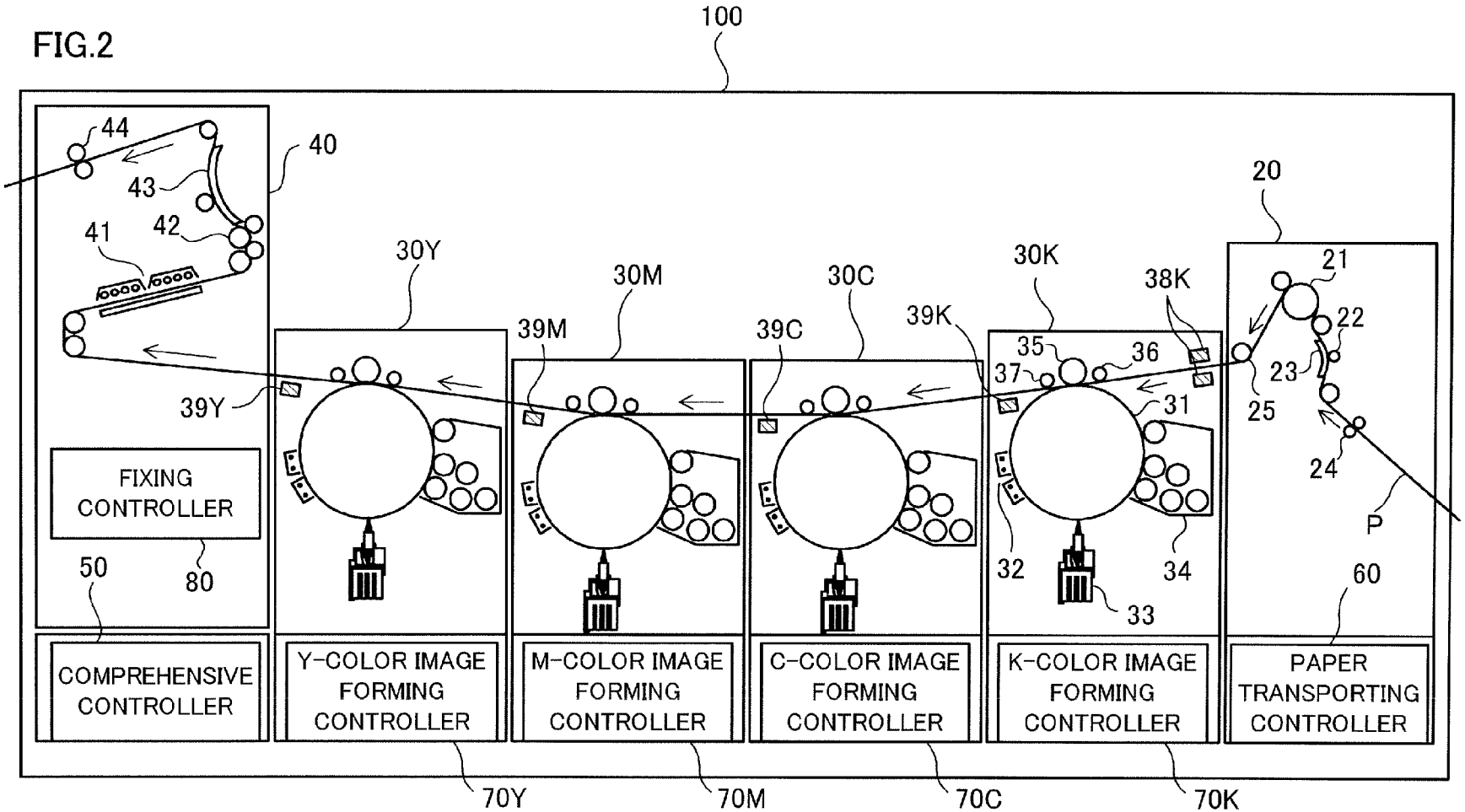
FIG. 2 is a view that shows a configuration of the first printer and the second printer according to the first exemplary embodiment (hereinafter, simply referred to as a "printer")

FIG. 2 is a view that shows a configuration of the first printer 100A and the second printer 100B according to the first exemplary embodiment (hereinafter, simply referred to as a "printer 100"). The printer 100 shown in FIG. 2 is an image forming apparatus with, for example, an electrophotographic type. The printer 100 is provided with, from the upstream side in the transportation direction (arrows in the figure) of the continuous paper P towards the downstream side, a paper transporting unit 20 that transports and drives the continuous paper P, and four image forming units, that is, a K-color image forming unit 30K that forms a toner image of black (K), a C-color image forming unit 30C that forms a toner image of cyan (C), a M-color image forming unit 30M that forms a toner image of magenta (M), and a Y-color image forming unit 30Y that forms a toner image of yellow (Y) on the continuous paper P. Further, the printer 100 is provided with a fixing unit 40 that fixes the color toner images.

In the paper transporting unit 20, from the upstream side to the downstream side in the transportation direction of the continuous paper P, back tension rolls 24, an aligning roll 22, a main drive roll 21 and a paper transportation direction changing roll 25 are arranged.

The main drive roll 21 has a function of nipping the continuous paper P with a predetermined pressure, receiving drive from a main motor (not shown in the figure) that is arranged in the paper transporting unit 20, and feeding the continuous paper P at a predetermined transportation speed. The aligning roll 22 has a function of cooperating with a guiding member 23 which is in a partially cylindrical shape, and constantly keeping a transportation route of the continuous paper P on the upstream side of the main drive roll 21. The back tension rolls 24 have a function of rotating at a lower speed than that of the main drive roll 21 and giving the tensile force to the continuous paper P on the upstream side of the main drive roll 21. The paper transportation direction changing roll 25 is a driven roll that is driven by winding and hanging the continuous paper P and has a function of changing the transportation direction of the continuous paper P that is fed from the main drive roll 21 to the direction towards the K-color image forming unit 30K.

Each of the K-color image forming unit 30K, the C-color image forming unit 30C, the M-color image forming unit 30M and the Y-color image forming unit 30Y (hereinafter, also collectively referred to as an "image forming unit 30") is provided with a photoconductor drum 31 serving as an image carrier, an electrically charging device 32 that electrically charges a surface of the photoconductor drum 31 at a predetermined potential, a LED printhead (LPH) 33 serving as an example of an exposure apparatus that exposes the surface of the photoconductor drum 31 on the basis of the image data, a developing device 34 that develops an electrostatic latent image formed on the surface of the photoconductor drum 31 by each of the color toners, a transfer device 35 that transfers the toner image formed on the surface of the photoconductor drum 31 to the continuous paper P, and a pair of transfer guiding rolls 36 and 37 that are arranged on the upstream side and the downstream side of the transfer device 35 respectively, and press the continuous paper P onto the photoconductor drum 31.

Further, the K-color image forming unit 30K is provided with a page resist mark reading unit 38K that reads a page resist mark (described later) for aligning the pages formed on any one of the front surface and the back surface of the continuous paper P or on both the front surface and the back surface, and outputs a timing signal. The K-color image forming unit 30K, the C-color image forming unit 30C, the M-color image forming unit 30M and the Y-color image forming unit are provided with color resist mark reading units 39K, 39C, 39M and 39Y as an example of an exposure position detecting unit that reads a color resist mark (described later) for aligning the color images formed on the surface of the continuous paper P, and outputs the timing signal and reading position data, respectively.

The fixing unit 40 is provided with a flash fixing device 41 that fixes the color toner images formed on the continuous paper P to the continuous paper P by a luminous body such as a flash lump in a non-contact state, tensile force giving roll members 42 that give the tensile force to the continuous paper P on the downstream side of the flash fixing device 41, an aligning member 43 that corrects the route of the continuous paper P in the width direction on the downstream side of the tensile force giving roll members 42, and tension rolls 44 that nip the continuous paper P in the vicinity of an exit, rotate at a higher speed than the transporting speed of the continuous paper P, and gives the tensile force to the continuous paper P.

Further, the printer 100 is provided with a comprehensive controller 50 serving as an example of a controller that controls an entire action of the printer 100, a paper transporting controller 60 that controls the paper transporting unit 20, a K-color image forming controller 70K serving as an example of a controller that controls an action of the K-color image forming unit 30K, a C-color image forming controller 70C serving as an example of a controller that controls an action of the C-color image forming unit 30C, a M-color image forming controller 70M serving as an example of a controller that controls an action of the M-color image forming unit 30M, a Y-color image forming controller 70Y serving as an example of a controller that controls an action of the Y-color image forming unit 30Y, and a fixing controller 80 that controls an action of the fixing unit 40.

The paper transporting controller 60, the K-color image forming controller 70K, the C-color image forming controller 70C, the M-color image forming controller 70M, the Y-color image forming controller 70Y, and the fixing controller 80 are comprehensively controlled by the comprehensive controller 50.

In the printing system 1 according to the first exemplary embodiment, when the printing system 1 is started, the image data for the front surface side and the image data for the back surface side are inputted from the control computer 600 to each of the comprehensive controller 50 of corresponding one of the printers 100 through the communication network 700. The comprehensive controller 50 divides the inputted image data into image data respectively corresponding to the K-color, C-color, the M-color and the Y-color, and sends the K-color image data, the C-color image data, the M-color image data and the Y-color image data to the K-color image forming controller 70K, the C-color image forming controller 70C, the M-color image forming controller 70M and the Y-color image forming controller 70Y, respectively.

In synchronization with the inputting of the image data to the comprehensive controller 50, the comprehensive controller 50 controls the paper transporting unit 20 through the paper transporting controller 60 and further controls the fixing unit 40 through the fixing controller 80 so as to transport the continuous paper P at a predetermined transportation speed while giving a predetermined tensile force to the continuous paper P.

Under the control of the comprehensive controller 50, the K-color image forming controller 70K, the C-color image forming controller 70C, the M-color image forming controller 70M and the Y-color image forming controller 70Y (hereinafter, collectively referred to as a "color image forming controller 70") control formation of each of the color toner images in corresponding one of the color image forming units 30.

That is, in the color image forming unit 30, under the control of the color image forming controller 70, the photoconductor drum 31 starts rotation, and the surface of the photoconductor drum 31 is electrically charged by the electrically charging device 32 at a predetermined potential (for example, −500 V). Further, by exposure by the LPH 33 that emits light on the basis of the color image data, the electrostatic latent image is formed. The electrostatic latent image on the photoconductor drum 31 is developed by the developing device 34 with the color toner to form the color toner image. The color toner image formed on the surface of the photoconductor drum 31 is transferred to the continuous paper P by the transfer device 35 and the transfer guiding rolls 36 and 37.

The continuous paper P is successively transported from the K-color image forming unit 30K to the Y-color image forming unit 30Y through the C-color image forming unit 30C and the M-color image forming unit 30M (30K→30C→30M→30Y). Thereby, the color toner images are superimposed with each other, and a full color toner image is formed on the continuous paper P.

After that, the continuous paper P on which the full color toner image is formed is transported to the fixing unit 40, and the toner image is fixed to the continuous paper P by the flash fixing device 41. Thereby, in the first printer 100A, the full color image is formed on the front surface side of the continuous paper P. In the same way, in the second printer 100B, the full color image is formed on the back surface side of the continuous paper P.

Subsequently, a description is given to the LED printhead (LPH) 33 that is provided in the first printer 100A and the second printer 100B according to the first exemplary embodiment.

Figure 3:
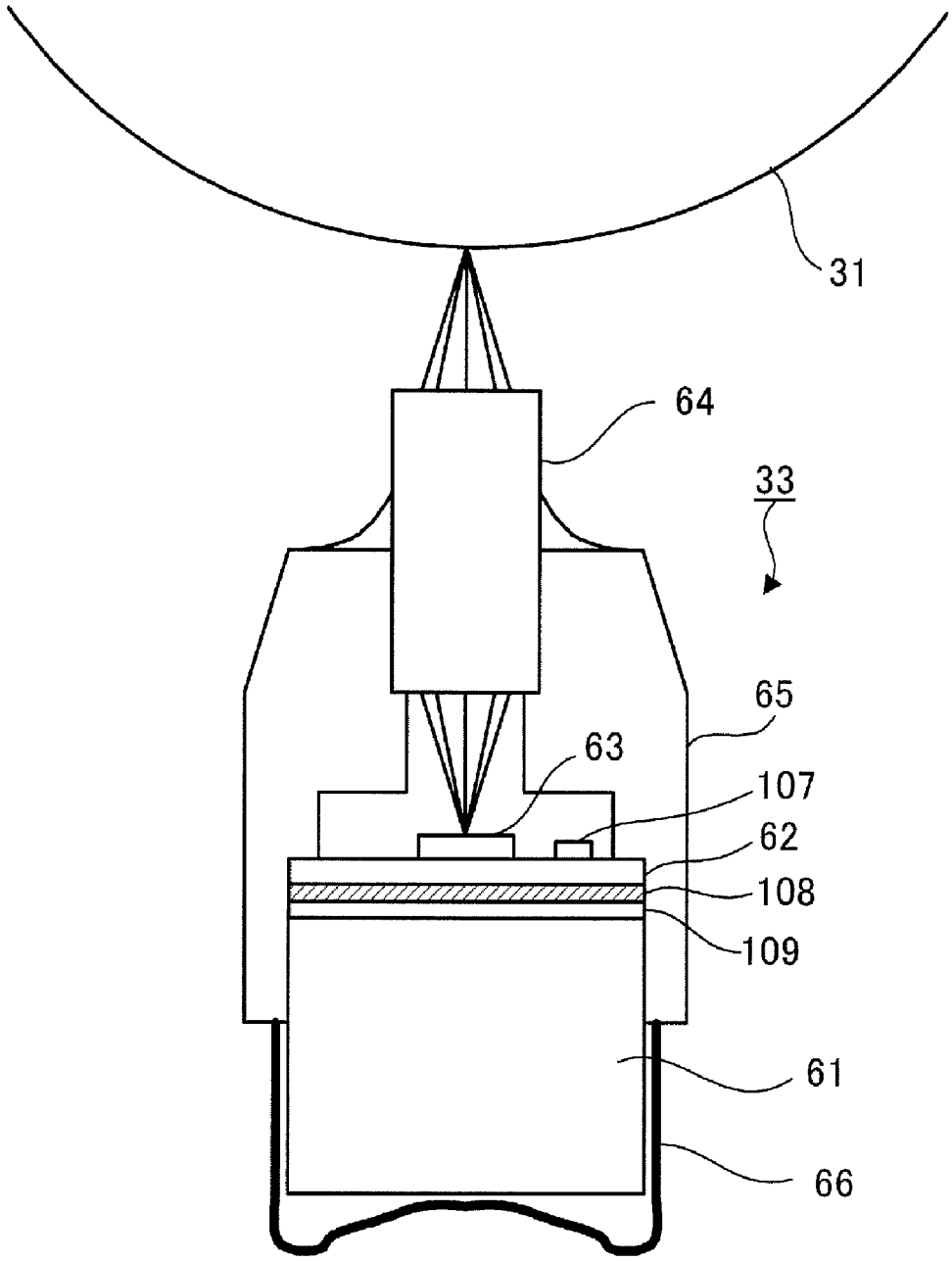
FIG. 3 is a sectional configuration view that shows a configuration of the LED printhead (LPH)

FIG. 3 is a sectional configuration view that shows a configuration of the LED printhead (LPH) 33. In FIG. 3, the LPH 33 is provided with a base 61 serving as a supporting body, a self-scanning LED array (SLED) 63, a LED circuit substrate 62 that mounts the SLED 63, a signal generating circuit 110 driving the SLED 63 and the like, a rod lens array 64 that forms an image with light irradiated from the SLED 63 on the surface of the photoconductor drum 31, and a holder 65 that shields the SLED 63 from the exterior while supporting the rod lens array 64, and a plate spring 66 that pressurizes the base 61 in the direction to the rod lens array 64.

The LPH 33 is provided with three sheet shape heaters 108A, 108B and 108C (hereinafter, also referred to as "sheet shape heaters 108" collectively) serving as an example of heating units that are arranged so as to be brought in contact with the LED circuit substrate 62 on the back surface side of the LED circuit substrate 62 (on the base 61 side), an insulating sheet 109 that is composed of a material with high thermal conductivity that electrically insulates between the sheet shape heaters 108 and the base 61, and three temperature sensors 107A, 107B and 107C (hereinafter, also referred to as "temperature sensors 107" collectively) that are arranged on the surface side of the LED circuit substrate 62 (on the rod lens array 64 side) and serve as an example of temperature measuring units that measure the temperatures of the LED circuit substrate 62.

The base 61 is formed by a block or a steel plate including a metal such as aluminum and SUS, and supports the LED circuit substrate 62. The holder 65 supports the base 61 and the rod lens array 64, and performs setting so as to maintain a predetermined optical positional relationship between the SLED 63 and the rod lens array 64. Further, the holder 65 is configured so as to seal the SLED 63. Thereby, the holder 65 prevents adhesion of dirt onto the SLED 63 from the exterior. Meanwhile, the plate spring 66 pressurizes the LED circuit substrate 62 on which the SLED 63 is installed in the rod lens array 64 direction through the base 61 so as to maintain the optical positional relationship between the SLED 63 and the rod lens array 64.

The LPH 33 that is configured as mentioned above is, by an adjusting screw (not shown in the figure), configured movably in the optical axis direction of the rod lens array 64 and adjusted so that an image forming position (focal point surface) of the rod lens array 64 is located on the surface of the photoconductor drum 31.

Figure 4A:
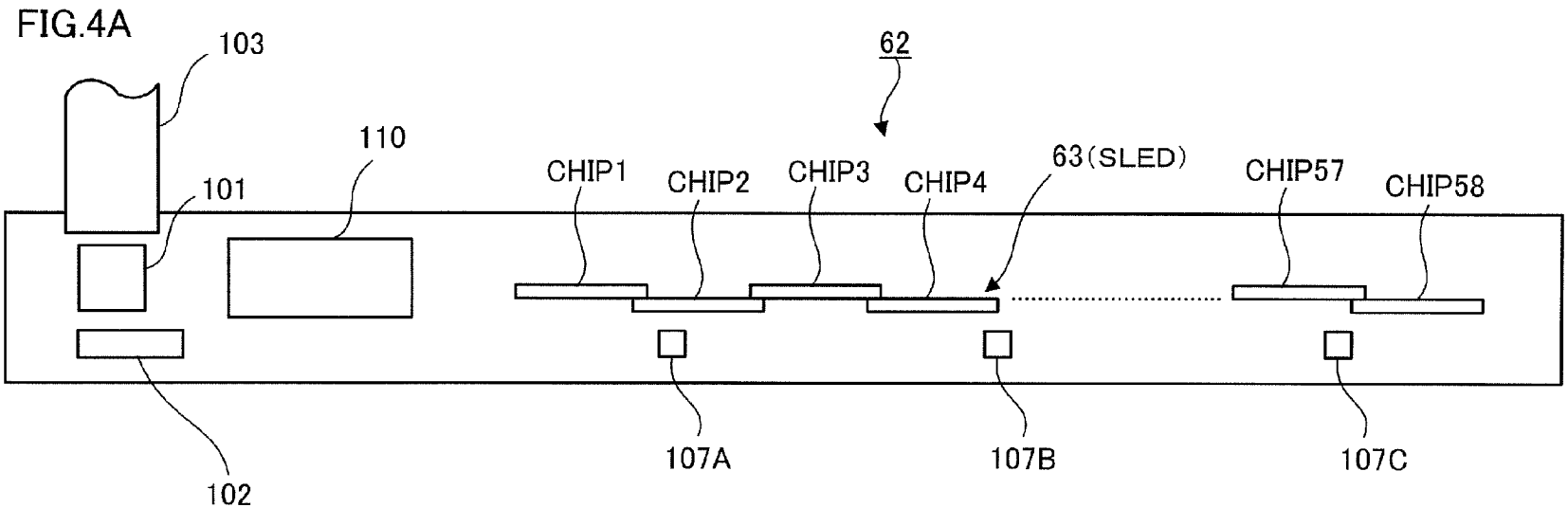
FIGS. 4A and 4B are plan views of the LED circuit substrate.
Figure 4B:
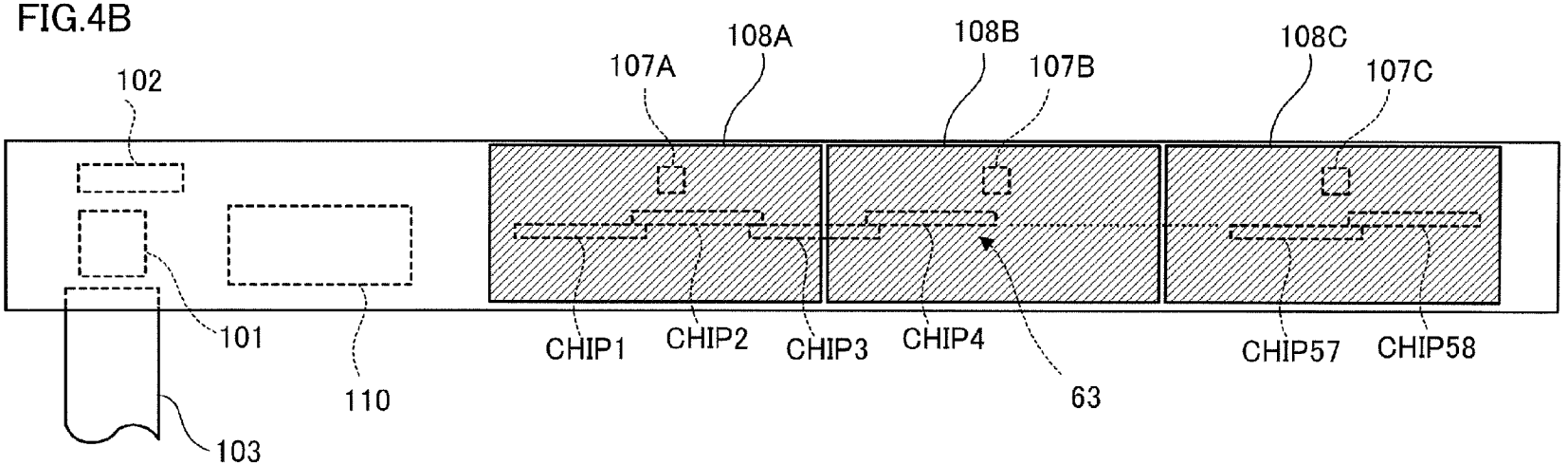

Here, FIGS. 4A and 4B are plan views of the LED circuit substrate 62: FIG. 4A shows the surface side of the LED circuit substrate 62 (the rod lens array 64 side); and FIG. 4B shows the back surface side (the base 61 side).

As shown in FIG. 4A, on the surface side of the LED circuit substrate 62, the SLED 63 including, for example, fifty-eight SLED chips (CHIP1 to CHIP58) is arranged in a line with high accuracy so as to be in parallel with the axial direction of the photoconductor drum 31. In such a case, on an end border of arrangement (LED array) of the light emitting elements (LED) that are arranged in the SLED chips (CHIP1 to CHIP58), the SLED chips are alternately arranged in a zigzag shape so that each LED array is continuously arranged in a connection portion between the SLED chips.

On the surface side of the LED circuit substrate 62, the signal generating circuit 110 that generates a signal for driving the SLEDs 63, a three terminal regulator 101 that outputs a predetermined voltage, an EEPROM 102 that stores light quantity correction data and the like for each LED, and a harness 103 that sends and receives a signal between the LED circuit substrate 62 and the color image forming controllers 70 and supplies electric power and the like are provided.

Further, on the surface side of the LED circuit substrate 62, the three temperature sensors 107A, 107B and 107C are arranged along the arrangement direction of the SLED 63 at equal intervals. That is, the temperature sensors 107A, 107B and 107C are arranged in central portions of respective three areas that are formed by dividing an area between one end portion of the arranged SLEDs 63 and the other end portion of the arranged SLEDs 63 into three.

The temperature sensors 107A, 107B and 107C measure the temperatures of the LED circuit substrate 62, respectively. Specifically, the temperature sensor 107A measures the substrate temperature in an end area that is located on the signal generating circuit 110 side among the areas mentioned above. The temperature sensor 107B measures the substrate temperature in a central area. The temperature sensor 107C measures the substrate temperature in an end area on the opposite side of the signal generating circuit 110 side. The temperature sensors 107A, 107B and 107C send their respective measured temperature values to the color image forming controllers 70.

Meanwhile, as shown in FIG. 4B, on the back surface side of the LED circuit substrate 62, corresponding to the arrangement position of the SLEDs 63 on the surface side, the three sheet shape heaters 108A, 108B and 108C are arranged in the arrangement direction of the SLEDs 63 at equal intervals so as to be brought in contact with the back surface of the LED circuit substrate 62. That is, the sheet shape heaters 108A, 108B and 108C are arranged respectively in the three areas that are formed by dividing the area between one end portion of the arranged SLEDs 63 and the other end portion of the arranged SLEDs 63 into three.

Therefore, the temperature sensors 107A, 107B and 107C and the sheet shape heaters 108A, 108B and 108C are arranged at positions corresponding to each other on the surface and the back surface respectively. Thereby, the sheet shape heater 108A heats the LED circuit substrate 62 in one end area on the signal generating circuit 110 side where the temperature sensor 107A measures the temperature. The sheet shape heater 108B heats the LED circuit substrate 62 in the central area where the temperature sensor 107B measures the temperature. The sheet shape heater 108C heats the LED circuit substrate 62 in the other end area on the opposite side of the signal generating circuit 110 side where the temperature sensor 107C measures the temperature.

Here, each of the sheet shape heaters 108A, 108B and 108C has a structure in which, for example, both surfaces of thin-layer stainless steel serving as a heating element are covered by a polyimide with thickness of approximately 0.2 mm.

It should be noted that the LPH 33 according to the first exemplary embodiment has a configuration where the three temperature sensors and the three sheet shape heaters are arranged. However, the number of the temperature sensors 107 and the number of the sheet shape heaters 108 may be properly set as appropriate in accordance with the structure of the LPH 33 as long as they are plural.

Next, a description is given to alignment of the image that is formed on each page in the first printer 100A and the second printer 100B according to the first exemplary embodiment. The alignment of the image includes alignment of the color toner images that is performed within each of the printers 100 and alignment of the pages that is performed in the first printer 100A and the second printer 100B so as to align positions of the pages of the images formed on both sides. Further, the alignment of the color toner images that is performed within each of the printers 100 includes alignment in the sub-scanning direction (the transportation direction of the continuous paper P) and alignment in the main scanning direction (the axis-line direction of the photoconductor drum 31). In the alignment in the sub-scanning direction of the first exemplary embodiment, timing for starting the exposure of the image in each of the LPHs 33 is adjusted. The alignment in the main scanning direction is performed by controlling the temperature of the LED circuit substrate 62 of each of the LPHs 33 and adjusting the length of the LED circuit substrate 62. The alignment of the color toner images is performed on the basis of the color resist mark (ROC), while the alignment of the pages is performed on the basis of the page resist mark (ROF).

In the printing system 1 according to the first exemplary embodiment, for example, the K-color image forming unit 30K that is located on the most upstream side of the first printer 100A forms the page resist mark (ROF) that is the fiducial of the alignment of the pages of the image formed in the second printer 100B. Each of the color image forming units 30 of the printers 100 forms the color resist mark (ROC) that is the fiducial of the alignment of the color toner images formed in the image forming units 30. It should be noted that a preprinted paper on which the page resist mark (ROF) is printed in advance may be used. In such a case, the K-color image forming unit 30K does not form the page resist mark (ROF).

Figure 5:
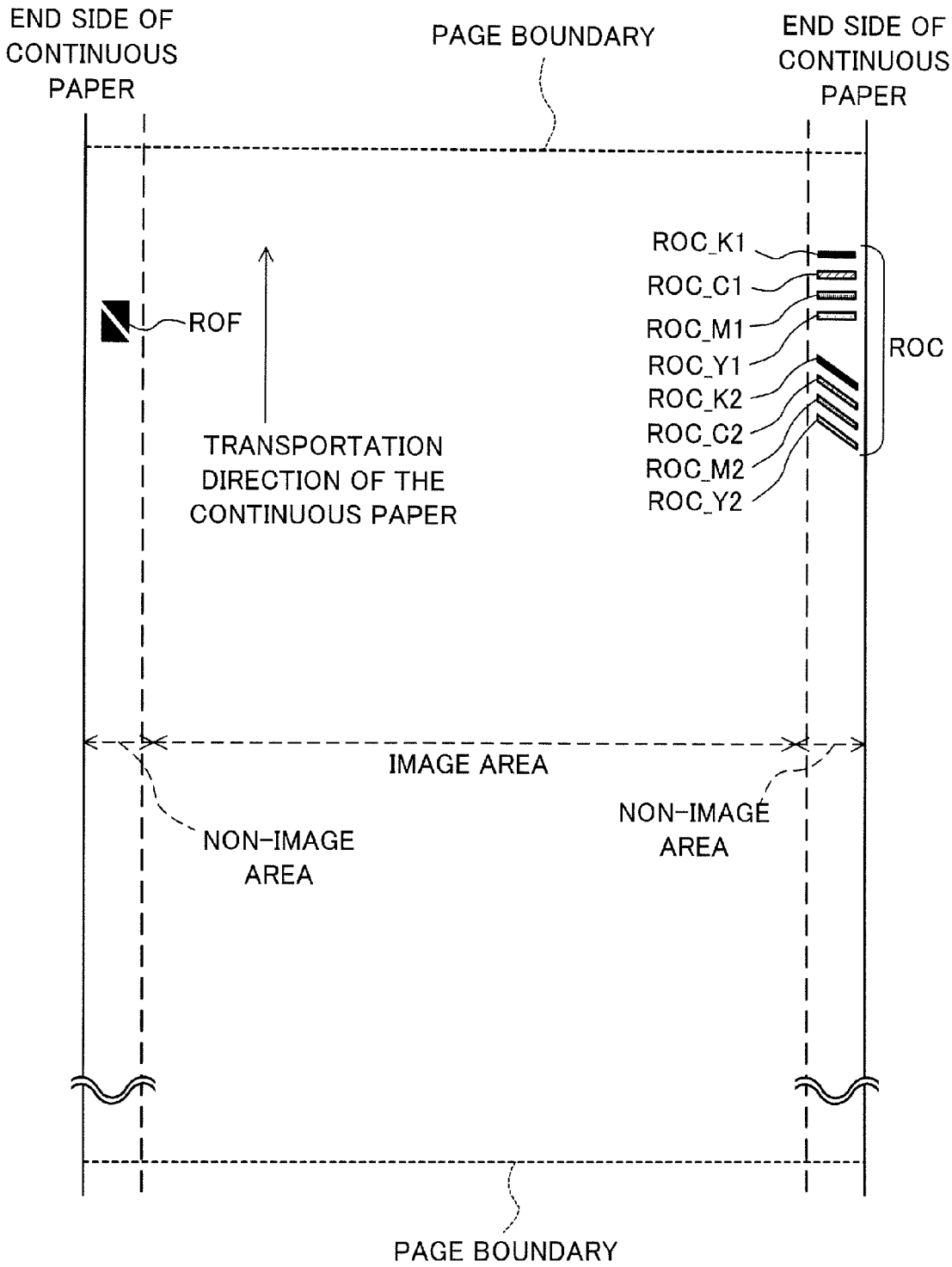
FIG. 5 is a view that shows an example of the page resist mark (ROF) and the color resist marks (ROC) formed on the continuous paper.

FIG. 5 is a view that shows an example of the page resist mark (ROF) and the color resist marks (ROC) formed on the continuous paper P. The page resist mark (ROF) and the color resist marks (ROC) shown in FIG. 5 are formed on non-image areas that are located on the both end sides other than an image area where the image is formed on the continuous paper P for each page. It should be noted that FIG. 5 shows the case where the color resist marks (ROC) are formed on one end side of the non-image areas, however, the color resist marks (ROC) may be formed on both end sides of the non-image areas. In such a case, color resist mark reading units 39K, 39C, 39M and 39Y are provided at two places on the both ends in the main scanning direction.

The alignment of the color toner images for each page that is performed in each of the printers 100 is performed as follows. Firstly, with regard to the alignment in the sub-scanning direction, a color resist mark of K-color (ROC_K1) is formed in the K-color image forming unit 30K of the first printer 100A, and a color resist mark of C-color (ROC_C1) is formed in the C-color image forming unit 30C on the downstream side thereof at a predetermined timing. The color resist mark reading unit 39C that is arranged on the downstream side of the transfer device 35 of the C-color image forming unit 30C generates timing signals that show timing when the color resist marks of K-color and the C-color (ROC_K1, ROC_C1) pass through respectively, and sends the signals to the C-color image forming controller 70C.

On the basis of time difference between the timing signals, the C-color image forming controller 70C generates alignment correction data in the sub-scanning direction (sub-scanning position correction data) at the time of forming the image in the C-color image forming unit 30C.

The C-color image forming controller 70C sets image formation starting timing in the sub-scanning direction on the basis of the generated sub-scanning position correction data and a page timing signal in the K-color image forming unit 30K described below, at the time of forming the image on a page that is next to the page where the color resist marks (ROC) serving as a basis for generating the sub-scanning position correction data are formed.

That is, as shown in FIG. 5, since the color resist marks (ROC) are formed within the page, the image formation starting timing in the color image forming units 30 for the page may not be set on the basis of the color resist marks (ROC) on the page. However, since the continuous paper P is continuously transported, the transportation speed is considered to be hardly changed between the page where the color resist marks (ROC) serving as a basis for setting the image formation starting timing are formed and the page that is next to the above page. Therefore, the color image forming controllers 70 set the image formation starting timing on each page on the basis of passage timing of the respective color resist marks (ROC) that are formed on the immediately previous page.

The same is true with regard to the page resist marks (ROF) described later. Therefore, at the time of forming the image on the first page, in advance, a blank page where only the page resist marks (ROF) and the color resist marks (ROC) serving as a basis of alignment of the pages and alignment of the color images on the first page is printed.

It should be noted that, as well as the above description, in the M-color image forming unit 30M, on the basis of the sub-scanning position correction data that is generated based on the color resist mark of K-color (ROC_K1) and the color resist mark of M-color (ROC_M1), and the page timing signal in the K-color image forming unit 30K described below, the image formation starting timing in the sub-scanning direction on the next page is set. In the Y-color image forming unit 30Y, on the basis of the sub-scanning position correction data that is generated based on the color resist mark of K-color (ROC_K1) and the color resist mark of Y-color (ROC_Y1), and the page timing signal in the K-color image forming unit 30K described below, the image formation starting timing in the sub-scanning direction on the next page is set.

Thereby, the alignment of the color toner images that are formed in the first printer 100A in the sub-scanning direction is performed with high accuracy. The same is true in the second printer 100B.

Meanwhile, with regard to alignment in the main scanning direction, when the color resist mark of K-color (ROC_K2) is formed in the K-color image forming unit 30K of the first printer 100A, the color resist mark reading unit 39K generates reading position data of the color resist mark of K-color (ROC_K2) and sends the data to the K-color image forming controller 70K. The K-color image forming controller 70K compares the reading position data of the color resist mark of K-color (ROC_K2) with standard position data that is set in advance, and generates alignment correction data (main scanning position correction data) with regard to the main scanning direction at the time of forming the image in the K-color image forming controller 70K. That is, the main scanning position correction data is data that shows a displacement amount from a predetermined standard position in the LED of the LED circuit substrate 62. On the basis of the main scanning position correction data, the temperatures of the LED circuit substrate 62 in the LPH 33 described later are controlled and length of the LED circuit substrate 62 is adjusted.

Similarly, in the C-color image forming unit 30C, on the basis of the main scanning position correction data that is generated from the color resist mark of C-color (ROC_C2), the temperatures of the LED circuit substrate 62 in the LPH 33 described later are controlled and the length of the LED circuit substrate 62 is adjusted. In the M-color image forming unit 30M, on the basis of the main scanning position correction data that is generated from the color resist mark of M-color (ROC_M2), the temperatures of the LED circuit substrate 62 in the LPH 33 described later are controlled and the length of the LED circuit substrate 62 is adjusted. Further, in the Y-color image forming unit 30Y, on the basis of the main scanning position correction data that is generated from the color resist mark of Y-color (ROC_Y2), the temperatures of the LED circuit substrate 62 in the LPH 33 described later are controlled and the length of the LED circuit substrate 62 is adjusted.

Thereby, the alignment of the color toner images that are formed in the first printer 100A in the main scanning direction (hereinafter, referred to as a "print width correction") is performed. The same is true in the second printer 100B.

The alignment of the pages between the image that is formed in the first printer 100A and the image that is formed in the second printer 100B is performed as follows. As mentioned above, the K-color image forming unit 30K that is located on the most upstream side of the first printer 100A forms the page resist mark (ROF) for each page of the continuous paper P (refer to FIG. 5). The page resist mark reading unit 38K that is arranged in the K-color image forming unit 30K of the second printer 100B reads the page resist mark (ROF) on each page, and generates the page timing signal that shows the timing when the page resist mark (ROF) passes through the page resist mark reading unit 38K. The generated page timing signal is sent to the K-color image forming controller 70K.

The K-color image forming controller 70K of the second printer 100B sets image forming timing in the K-color image forming unit 30K on the basis of the acquired page timing signal. Then, on the basis of the set image forming timing, the K-color image forming controller 70K starts the exposure with the LPH 33.

The K-color image forming controller 70K sends the page timing signal to the comprehensive controller 50. The comprehensive controller 50 sends the page timing signal to the image forming controllers 70 of the color image forming units 30 other than the K-color image forming unit 30K. The image forming controllers 70 of the color image forming units 30 set the image formation starting timing on the basis of the acquired page timing signal and the sub-scanning position correction data mentioned above, and starts exposure by the LPH 33.

As mentioned above, the second printer 100B according to the first exemplary embodiment is configured so that the image forming timing in each of the color image forming units 30 is set on the basis of the timing when the page resist mark (ROF) that is formed on the continuous paper P passes through the page resist mark reading unit 38K of the K-color image forming unit 30K. That is, in the printing system 1 according to the first exemplary embodiment, since the exposure start timing of each of the color image forming units 30 is set on the basis of the position of the page resist mark (ROF) on the continuous paper P, the alignment of the pages with the image that is formed on the front surface in the first printer 100A and the image that is formed on the back surface in the second printer 100B is performed.

Subsequently, a description is given to the alignment of the color toner images in the main scanning direction (the print width correction) in the printers 100 according to the first exemplary embodiment.

As mentioned above, the print width correction is performed by controlling the temperature of the LED circuit substrate 62 of the LPH 33 that is arranged in each of the color image forming units 30 and adjusting the length of the LED circuit substrate 62.

With regard to each SLED 63 that is arranged on the LED circuit substrate 62, an arrangement position thereof varies at the time of manufacturing. Therefore, among the color image forming units 30, original displacement in the arrangement position of the LED is generated.

Although each of the LEDs that configures the SLED 63 is a light emitting element with a relatively small heat quantity, for example, the number of the LEDs is about 12,000 in the case where the LEDs are arranged in the LPH 33 that has the overall length of 500 mm with a resolution of 600 dpi (dot per inch). Therefore, a large heat quantity to the extent that expands the LED circuit substrate 62 is generated. Thereby, the displacement in the arrangement position of the LEDs on the LED circuit substrate 62 is also generated.

In general, a thermal expansion rate of a print substrate that forms the LED circuit substrate 62 is approximately 10 μm/degree C. for 500 mm, for example. Therefore, in the above-mentioned LPH 33 of 500 mm that has the resolution of 600 dpi, the overall length is changed by approximately 300 μm. Thereby, in the case where a LED lighting rate is different according to each of the color image forming units 30 and the like, there is sometimes a case where each of heat expansion amounts of the LED circuit substrates 62 is different and hence color drift that is difficult to be overlooked is generated in the image. Particularly, since the lighting rate in the K-color image forming unit 30K is often high, the thermal expansion amount of the LED circuit substrate 62 highly tends to be increased.

In the case where the LED lighting rate is different according to an image area, a temperature distribution is generated in the longitudinal direction of the LED circuit substrate 62 so that there is sometimes a case where a deformation or a warp is generated in the LED circuit substrate 62. In such a case, there is sometimes a case where light from the LED is not formed into the image on the photoconductor drum 31, so that image failure may be generated.

Meanwhile, each of the color image forming units 30 is provided with a cooling unit (not shown in the figure) that cools down the LPH 33 such as a fan. However, since the difference of the lighting rates and the like is not to be avoided even with the cooling unit, it is difficult to cool down the LPH 33 so as to make the temperature distribution of the LPH 33 uniform. Particularly, it is difficult to eliminate a tendency in which the temperatures are relatively low in both ends of the LPH 33 where a heat dissipation amount is large, and the temperature is relatively high in a central portion where heat dissipation is not easily generated. As in the printers 100 according to the first exemplary embodiment, in the case where the color image forming units 30 are formed within frame bodies thereof respectively, due to difference of internal temperatures, it is difficult to adjust the temperatures of the LPHs 33 to the same level by the cooling unit.

Then, in the printer 100 according to the first exemplary embodiment, the temperatures in the LED circuit substrate 62 of the LPH 33 arranged in each of the color image forming units 30 are controlled and hence the thermal expansion amount of the LED circuit substrate 62 is adjusted. Thereby, each displacement amount of the LED on the LED circuit substrate 62 of the LPH 33 arranged in the color image forming unit 30 is controlled to be substantially the same so as to perform the print width correction.

The three temperature sensors 107A, 107B and 107C are provided along the arrangement direction of the SLED 63, and the three sheet shape heaters 108A, 108B and 108C are provided corresponding to the arrangement position of the temperature sensors. The respective areas where the temperature sensors and the sheet shape heaters are arranged are independently controlled. Thereby, while temperature adjustment of the entire LED circuit substrate 62 is performed, the temperature distribution in the longitudinal direction is adjusted so as to be substantially uniform.

Figure 6:
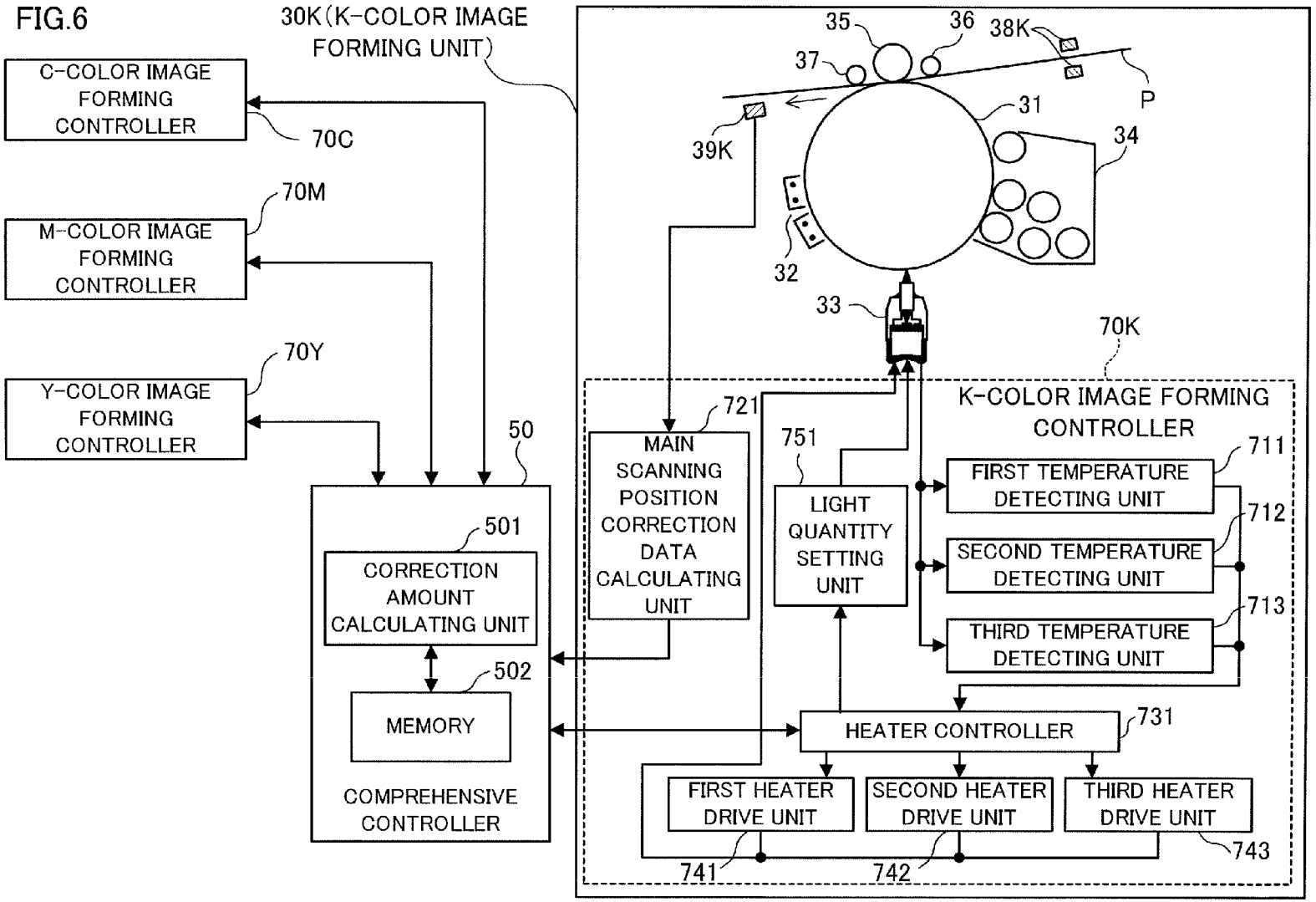
FIG. 6 is a view that explains a function configuring unit that performs the print width correction in the printers according to the first exemplary embodiment.

FIG. 6 is a view that explains a function configuring unit that performs the print width correction in the printers 100 according to the first exemplary embodiment. As shown in FIG. 6, the print width correction is performed under the control of the color image forming controllers 70 and the comprehensive controller 50. It should be noted that in FIG. 6, a description is given taking the K-color image forming unit 30K as an example.

As the function configuring unit that performs the print width correction, the K-color image forming controller 70K is provided with a first temperature detecting unit 711, a second temperature detecting unit 712, a third temperature detecting unit 713, a main scanning position correction data calculating unit 721, a heater controller 731, a first heater drive unit 741, a second heater drive unit 742, and a third heater drive unit 743. The comprehensive controller 50 is provided with a correction amount calculating unit 501 and a memory 502.

Further, as the function unit that performs setting of the light quantity of the LPH 33 in association with the print width correction, the K-color image forming controller 70K is provided with a light quantity setting unit 751 serving as an example of a light quantity setting device.

It should be noted that a CPU (not shown in the figure) of the K-color image forming controller 70K reads a program that executes functions of the first temperature detecting unit 711, the second temperature detecting unit 712, the third temperature detecting unit 713, the main scanning position correction data calculating unit 721, the heater controller 731, the first heater drive unit 741, the second heater drive unit 742, the third heater drive unit 743, and the light quantity setting unit 751 from a main memory (not shown in the figure) into a RAM or the like within the K-color image forming controller 70K so as to perform various processing.

In the K-color image forming controller 70K, the first temperature detecting unit 711 acquires the measured temperature value from the temperature sensor 107A on the LED circuit substrate 62. Thereby, the first temperature detecting unit 711 detects the substrate temperature in the one end area that is located on the signal generating circuit 110 side in the LED circuit substrate 62, and sends the substrate temperature to the heater controller 731 as temperature data of the one end area that is located on the signal generating circuit 110 side. The second temperature detecting unit 712 acquires the measured temperature value from the temperature sensor 107B on the LED circuit substrate 62. Thereby, the second temperature detecting unit 712 detects the substrate temperature in the central area in the arrangement of the SLEDs 63 in the LED circuit substrate 62, and sends the substrate temperature to the heater controller 731 as temperature data of the central area. The third temperature detecting unit 713 acquires the measured temperature value from the temperature sensor 107C on the LED circuit substrate 62. Thereby, the third temperature detecting unit 713 detects the substrate temperature in the other end area on the opposite side of the signal generating circuit 110 side of the SLEDs 63 in the LED circuit substrate 62, and sends the substrate temperature to the heater controller 731 as temperature data of the other end area on the opposite side.

As mentioned above, the main scanning position correction data calculating unit 721 compares the reading position data of the color resist mark of K-color (ROC_K2) that is generated in the color resist mark reading unit 39K with the standard position data that is set in advance, and generates the main scanning position correction data. The main scanning position correction data is to show the displacement amount from the predetermined standard position of the LED in the K-color image forming unit 30K. The generated main scanning position correction data is sent to the comprehensive controller 50.

On the basis of the temperature data of the areas that is acquired from the first temperature detecting unit 711, the second temperature detecting unit 712 and the third temperature detecting unit 713, and a correction amount that is calculated in the correction amount calculating unit 501 of the comprehensive controller 50 (described later), the heater controller 731 sets a supplying amount of electric power to the respective three sheet shape heaters 108A, 108B and 108C that are arranged on the back surface side of the LED circuit substrate 62.

That is, the heater controller 731 stores a correspondence relationship between the substrate temperature in the LPH 33 and a position changing amount of the LED in, for example, a ROM or the like (not shown in the figure) serving as an example of a memory, as a table. For example, from a size of the LED circuit substrate 62 in the longitudinal direction and the thermal expansion rate of a material that forms the LED circuit substrate 62, the correspondence relationship between the substrate temperature of the LPH 33 and the position changing amount of the LED is determined. With using the table, target temperature values for respective areas are set from the temperature data of the areas and the correction amount, and the supplying amount of electric power to the respective sheet shape heaters 108A, 108B and 108C that adjusts the temperatures in the areas to the set target temperature values is set.

The heater controller 731 sends data on the target temperature values (target set temperature data) that is set in the areas of the LED circuit substrate 62 to the light quantity setting unit 751.

The first heater drive unit 741 supplies the electric power that is set by the heater controller 731 to the sheet shape heater 108A. The second heater drive unit 742 supplies the electric power that is set by the heater controller 731 to the sheet shape heater 108B. The third heater drive unit 743 supplies the electric power that is set by the heater controller 731 to the sheet shape heater 108C.

The light quantity setting unit 751 sets light quantity values in the LPH 33 on the basis of the target set temperature data in the areas that is acquired from the heater controller 731. With regard to setting of the light quantity values, a description is given later.

In the comprehensive controller 50, the memory 502 stores an initial displacement amount of the LED in the main scanning direction for each LPH 33 that is installed in the color image forming unit 30. The initial displacement amount here is an amount that is preliminarily measured at a predetermined temperature (for example, 20 degrees C.) as, for example, the displacement amount to a designed amount at the time of manufacturing. At the time of manufacturing the printer 100, the initial displacement amount for each LPH 33 that is installed in the color image forming unit 30 is stored in the memory 502 as, for example, 4-bit data.

The correction amount calculating unit 501 extracts the LPH 33 with, for example, the largest initial displacement amount among the LPHs 33 of the color image forming units 30 from the initial displacement amounts of LPHs 33 that are stored in the memory 502. On the basis of the LPH 33 with the largest initial displacement amount, the correction amount in the LPHs 33 of other image forming units 30 is calculated. That is, on the basis of the main scanning position correction data (the displacement amount) of the LPH 33 serving as the basis, a difference from the main scanning position correction data (the displacement amount) of each of the LPHs 33 of other color image forming units 30 is calculated. The difference is sent to the heater controller 731 of the color image forming controllers 70 as the correction amount. The calculated correction amount here is an amount of adjusting the length of the LED circuit substrate 62 that makes the position changing amount of each of the LPHs 33 of the other image forming units 30 the same as that of the LPH 33 serving as the basis.

Figure 7:
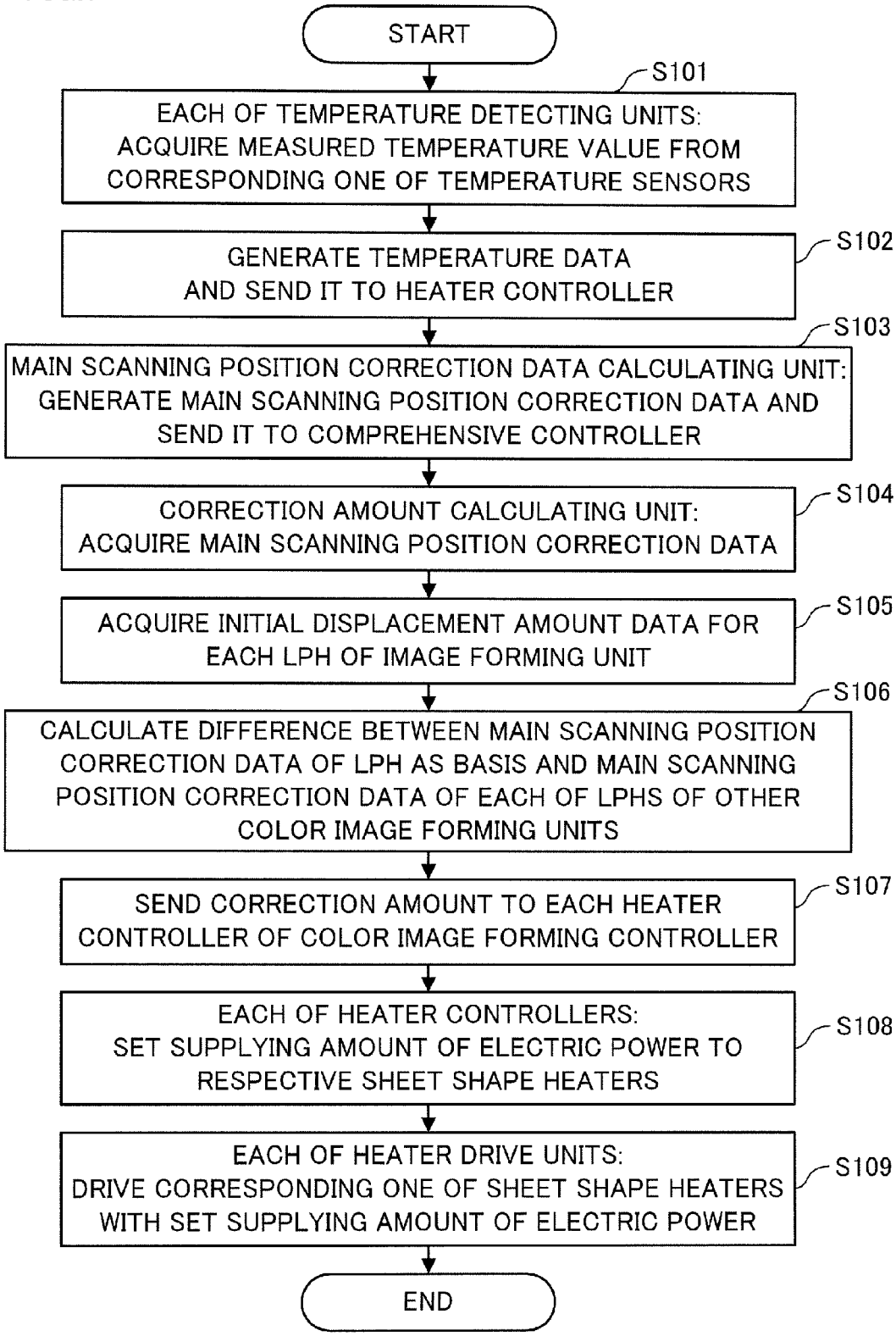
FIG. 7 is a flowchart that shows an example of the procedure at the time of performing the print width correction.

Subsequently, a description is given to a procedure at the time of performing the print width correction in the printers 100 according to the first exemplary embodiment. FIG. 7 is a flowchart that shows an example of the procedure at the time of performing the print width correction. The procedure is, as mentioned above, performed under the control of the color image forming controllers 70 and the comprehensive controller 50. Here, a description is given with using the configuration shown in FIG. 6.

As shown in FIG. 7, firstly, the first temperature detecting unit 711, the second temperature detecting unit 712 and the third temperature detecting unit 713 acquire the measured temperature values from the temperature sensor 107A, the temperature sensor 107B and the temperature sensor 107C respectively (S101). The temperature data of the areas are generated from the acquired measured temperature values and sent to the heater controller 731 (S102).

The main scanning position correction data calculating unit 721 generates the main scanning position correction data on the basis of the reading position data of the color resist mark of K-color (ROC_K2) that is acquired from the color resist mark reading unit 39K, and sends the main scanning position correction data to the comprehensive controller 50 (S103).

The correction amount calculating unit 501 of the comprehensive controller 50 acquires the main scanning position correction data from the color image forming controllers 70 (S104). Initial displacement amount data for each LPH 33 of the color image forming unit 30 is acquired from the memory 502 (S105). On the basis of the LPH 33 with the largest initial displacement amount among the LPHs 33 of the color image forming units 30, the difference between the main scanning position correction data of the LPH 33 serving as the basis and the main scanning position correction data of each of the LPHs 33 of other color image forming units 30 is calculated (S106). The correction amount calculating unit 501 sends the calculated difference to each heater controller 731 of the color image forming controller 70 as the correction amount in each LPH 33 (S107).

On the basis of the temperature data that is acquired from the first temperature detecting unit 711, the second temperature detecting unit 712 and the third temperature detecting unit 713 and the correction amount data that is acquired from the comprehensive controller 50, the heater controller 731 sets the supplying amount of electric power to the respective sheet shape heaters 108A, 108B and 108C (S108) That is, on the basis of the acquired temperature data of the areas and the correction amount data that is acquired from the comprehensive controller 50, the target temperature values for respective areas of the LED circuit substrate 62 are set so that the displacement amount of the LED on the LED circuit substrate 62 substantially matches the displacement amount of the LED on the LED circuit substrate 62 of the LPH 33 serving as the basis, and the temperature distribution of the LED circuit substrate 62 becomes uniform in the longitudinal direction. The supplying amount of electric power to the respective sheet shape heaters 108A, 108B and 108C that adjust the temperatures in the areas to the set target temperature values is set.

The heater controller 731 sends the set supplying amount of electric power to the sheet shape heaters 108A, 108B and 108C to the first heater drive unit 741, the second heater drive unit 742 and the third heater drive unit 743 respectively. The first heater drive unit 741, the second heater drive unit 742 and the third heater drive unit 743 drive the sheet shape heaters 108A, 108B and 108C respectively with the set supplying amount of electric power (S109).

In each LPH 33 according to the first exemplary embodiment, along the arrangement position of the SLEDs 63, the three sheet shape heaters 108A, 108B and 108C are arranged in the arrangement direction of the SLEDs 63. In correspondence with the temperature distribution that is generated in the LED circuit substrate 62, the set temperatures of the three sheet shape heaters 108A, 108B and 108C are adjusted respectively. Thereby, the displacement amount of the LED on the LED circuit substrate 62 is controlled for each of the plural areas that are divided in the longitudinal direction of the LED circuit substrate 62.

Figure 8:
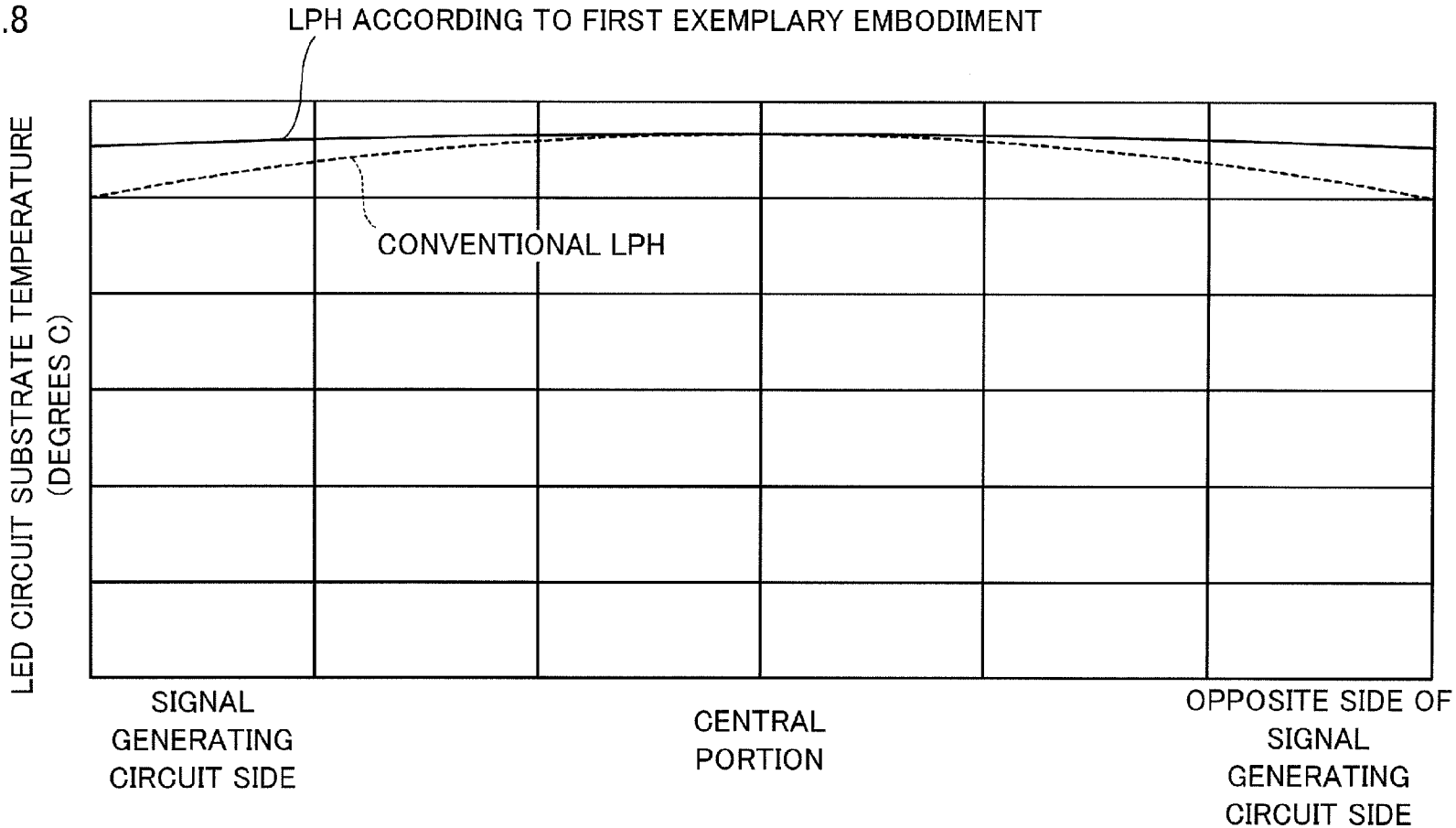
FIG. 8 is a graph that compares the temperature distribution of the LED circuit substrate in the LPH according to the first exemplary embodiment and a temperature distribution of the conventional LED circuit substrate where the sheet shape heaters are not arranged.

FIG. 8 is a graph that compares the temperature distribution of the LED circuit substrate 62 in the LPH 33 according to the first exemplary embodiment and a temperature distribution of the conventional LED circuit substrate where the sheet shape heaters 108A, 108B and 108C are not arranged. As shown in FIG. 8, in the LPH 33 according to the first exemplary embodiment, the temperatures of the LED circuit substrate 62 are set substantially uniformly.

As mentioned above, in each LPH 33 according to the first exemplary embodiment, by the three sheet shape heaters 108A, 108B and 108C that are arranged in the arrangement direction of the SLEDs 63, the length of each of the LED circuit substrates 62 in the LPHs 33 of the image forming units 30 is set so that the displacement amount of the LED becomes uniform, and the temperature distribution of the LED circuit substrate 62 in each of the LPH 33 is set substantially uniformly. Thereby, the LEDs of the LPHs 33 are aligned with each other.

Next, a description is given to the light quantity setting unit 751 according to the first exemplary embodiment. The light quantity setting unit 751 sets the light quantity values at the time of performing the light quantity control of each of the areas for controlling uniformly the light quantity of the LEDs which are arranged in each of the areas. That is, the light emitting amount of the LED that constitutes the SLED 63 of the LPH 33 is changed depending on the temperature. Then, the light quantity setting unit 751 sets the light quantity corresponding to the temperature change of the LED. Here, the light quantity setting unit 751 stores a relationship between the temperature and the light emitting amount of the LED measured in advance as a table. The light quantity setting unit 751 sets the light quantity values in each of the areas from the target set temperature data in the areas of the LED circuit substrate 62 that is acquired from the heater controller 731 and the relationship between the temperature and the light emitting amount of the LED stored in the table.

It should be noted that the light quantity correction control that controls the light quantity of each LED is set on the basis of the light quantity correction data that is stored in the EEPROM 102 of the LED circuit substrate 62.

As mentioned above, in each of the printers 100 according to the first exemplary embodiment, along the arrangement direction of the SLEDs 63, the three temperature sensors 107A, 107B and 107C and the three sheet shape heaters 108A, 108B and 108C are arranged at positions corresponding to each other on the surface and the back surface respectively, and the temperatures of the LED circuit substrate 62 are controlled for each of the areas.

Thereby, the alignment of the LEDs between each of the LPHs 33 is performed. In correspondence with the temperatures that are set for each of the areas of each LPH 33, the light emitting amount of the LED is adjusted for each of the areas respectively.

Second Exemplary Embodiment

In the printing system 1 according to the first exemplary embodiment, the description is given to the configuration where the first printer 100A and the second printer 100B are arranged so that full-color images are formed on the both sides of the continuous paper P respectively. In a printing system 2 according to the second exemplary embodiment, a description is given to a configuration where four printers are arranged so that color toner images are formed on one side of the continuous paper P. It should be noted that the same reference numerals are used for the same configuration as in the first exemplary embodiment, and a detailed explanation thereof is omitted.

Figure 9:
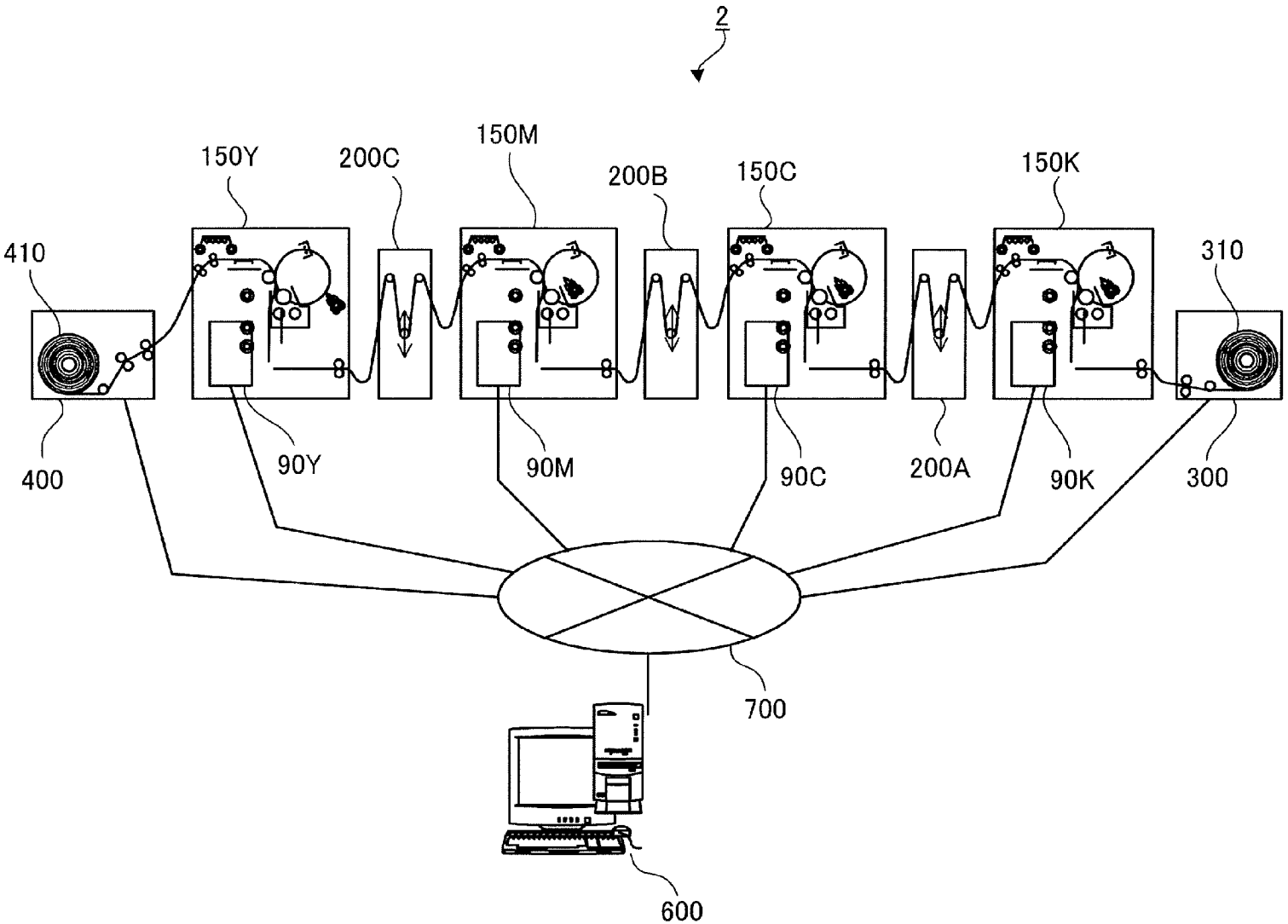
FIG. 9 is a view that shows an entire configuration of the printing system according to the second exemplary embodiment.

FIG. 9 is a view that shows an entire configuration of the printing system 2 according to the second exemplary embodiment. The printing system 2 shown in FIG. 9 is configured by connecting four printers serving as an example of the image forming apparatus that forms the color image on the one side of the continuous paper P. From the upstream side in the conveying direction of the continuous paper P towards the downstream side, the printing system 2 is provided with a continuous paper supplying apparatus 300, a K-color printer 150K serving as an example of the image forming unit that forms a toner image of black (K) on the continuous paper P, a first buffer unit 200A, a C-color printer 150C serving as an example of the image forming unit that forms a toner image of cyan (C) on the continuous paper P, a second buffer unit 200B, a M-color printer 150M serving as an example of the image forming unit that forms a toner image of magenta (M) on the continuous paper P, a third buffer unit 200C, a Y-color printer 150Y serving as an example of the image forming unit that forms a toner image of yellow (Y) on the continuous paper P, and a continuous paper winding apparatus 400.

In the printing system 2 according to the second exemplary embodiment, a control computer 600 that controls operations of the K-color printer 150K, the C-color printer 150C, the M-color printer 150M and the Y-color printer 150Y is connected to the K-color printer 150K, the C-color printer 150C, the M-color printer 150M and the Y-color printer 150Y through a communication network 700.

It should be noted that, hereinafter, the K-color printer 150K, the C-color printer 150C, the M-color printer 150M and the Y-color printer 150Y are also referred to as color printers 150 collectively.

Figure 10:
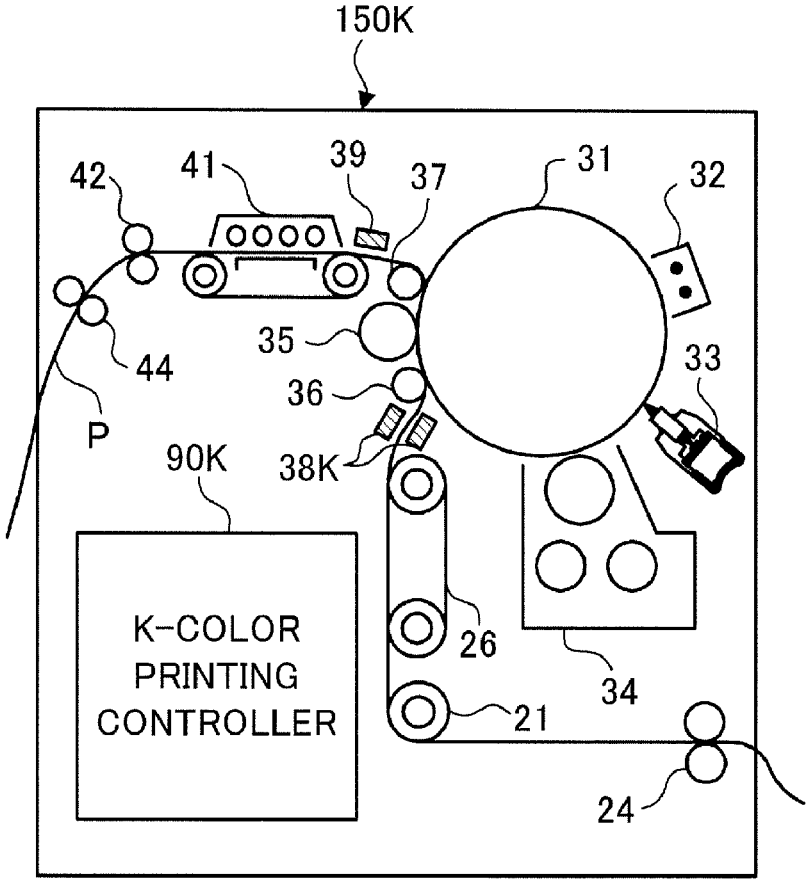
FIG. 10 is a view that shows a configuration of the K-color printer of the second exemplary embodiment.

Next, a description is given to the K-color printer 150K of the second exemplary embodiment. FIG. 10 is a view that shows a configuration of the K-color printer 150K of the second exemplary embodiment. The K-color printer 150K shown in FIG. 10 is an image forming apparatus with, for example, an electrophotography, and is provided with a photoconductor drum 31 serving as an image carrier, an electrically charging device 32 that electrically charges a surface of the photoconductor drum 31 at a predetermined potential, a LED printhead (LPH) 33 that exposes the surface of the photoconductor drum 31 on the basis of the image data, a developing device 34 that develops an electrostatic latent image formed on the surface of the photoconductor drum 31 by K-color toner, a transfer device 35 that transfers the toner image formed on the surface of the photoconductor drum 31 to the continuous paper P, a pair of transfer guiding rolls 36 and 37 that are arranged on the upstream side and the downstream side of the transfer device 35 respectively, and press the continuous paper P onto the photoconductor drum 31, and a flash fixing device 41 that fixes the toner images formed on the continuous paper P by flashing.

Further, the K-color printer is provided with a page resist mark reading unit 38K that reads a page resist mark formed on any one of the front surface and the back surface of the continuous paper P or on both the front surface and the back surface, and outputs a timing signal, and a color resist mark reading unit 39K as an example of an exposure position detecting unit that reads a color resist mark for aligning the K-color image formed on the surface of the continuous paper P, and outputs the reading position data.

As a paper supplying and transporting system, back tension rolls 24, a main drive roll 21 that receives drive from a main motor (not shown in the figure), and a transportation belt member 26 are provided. As a paper exit system, tensile force giving roll members 42 that apply tensile force on the continuous paper P, and tension rolls 44 that nip the continuous paper P in the vicinity of an exit and rotate at circumferential speed that is faster than the transportation speed of the continuous paper P so as to apply the tensile force on the continuous paper P are provided.

Further, a K-color printing controller 90K that controls the operation of the entire K-color printer 150K is provided.

It should be noted that the C-color printer 150C, the M-color printer 150M and the Y-color printer 150Y are configured similarly to the K-color printer 150K.

The K-color printing controller 90K serving as an example of a controller that controls the operation of the entire K-color printer 150K, a C-color printing controller 90C serving as an example of the controller that controls the operation of the entire C-color printer 150C, a M-color printing controller 90M serving as an example of the controller that controls the operation of the entire M-color printer 150M, and a Y-color printing controller 90Y serving as an example of the controller that controls the operation of the entire Y-color printer 150Y have the same functions as the comprehensive controller 50 and the color image forming controllers 70 of the printer 100 according to the first exemplary embodiment, and are connected to the control computer 600 through the communication network 700.

The K-color printer 150K according to the second exemplary embodiment prints a K-color image on the continuous paper P that is supplied from the continuous paper supplying apparatus 300 under the control of the K-color printing controller 90K.

Specifically, when the printing system 2 according to the second exemplary embodiment is started, K-color image data is inputted from the control computer 600 to the K-color printing controller 90K of the K-color printer 150K through the communication network 700. In synchronization with the input of the K-color image data to the K-color printing controller 90K, the transportation of the continuous paper P is started at predetermined speed, and the photoconductor drum 31 starts rotating. The surface of the photoconductor drum 31 is electrically charged by the electrically charging device 32 at a predetermined potential (for example, −500 V), and by the LPH 33, an electrostatic latent image corresponding to the K-color image data is formed. Then, the electrostatic latent image on the photoconductor drum 31 is developed by the developing device 34 with the K-color toner to form the K-color toner image. The color toner image that is formed on the surface of the photoconductor drum 31 is transferred onto the continuous paper P by the transfer device 35 and the transfer guiding rolls 36 and 37. Thereby, the K-color toner image is formed on the continuous paper P.

Then, onto the continuous paper P on which the K-color toner image is formed, the K-color image is fixed by the flash fixing device 41.

The continuous paper P on which the K-color image is printed in the K-color printer 150K is transported to the first buffer unit 200A. While a predetermined set amount of the continuous paper P is held in the first buffer unit 200A, the continuous paper P is transported to the C-color printer 150C.

With the same process, the C-color printer 150C prints the C-color image onto the continuous paper P that is supplied from the first buffer unit 200A, while aligning the pages to the K-color image that is printed in the K-color printer 150K. The continuous paper P on which the C-color image is superimposingly printed on the K-color image in the C-color printer 150C is transported to the second buffer unit 200B. While the predetermined set amount of the continuous paper P is held in the second buffer unit 200B, the continuous paper P is transported to the M-color printer 150M.

With the same process, the M-color printer 150M prints the M-color image onto the continuous paper P that is supplied from the second buffer unit 200B, while aligning the pages to the K-color image that is printed in the K-color printer 150K. The continuous paper P on which the M-color image is superimposingly printed on the K-color image and the C-color image in the M-color printer 150M is transported to the third buffer unit 200C. While the predetermined set amount of the continuous paper P is held in the third buffer unit 200C, the continuous paper P is transported to the Y-color printer 150Y.

With the same process, the Y-color printer 150Y prints the Y-color image onto the continuous paper P that is supplied from the third buffer unit 200C, while aligning the pages to the K-color image that is printed in the K-color printer 150K. The continuous paper P on which the Y-color image is superimposingly printed on the K-color image, the C-color image and the M-color image so as to form a full-color image in the Y-color printer 150Y is transported to the continuous paper winding apparatus 400 and is wounded by the windig roll 410.

The K-color printer 150K that is arranged on the most upstream side prints the page resist marks (ROF) serving as a basis of the page position at the time of forming the image in the C-color printer 150C, the M-color printer 150M and the Y-color printer 150Y that are arranged on the downstream side (refer to FIG. 5). In the C-color printer 150C, the M-color printer 150M and the Y-color printer 150Y, on the basis of the page resist marks (ROF), in order to align the pages to the K-color image that is printed in the K-color printer 150K, image forming timing of the C-color image, the M-color image and the Y-color image is set respectively. Here, in the printing system 2 according to the second exemplary embodiment, since the respective color toner images are formed on the one side of the continuous paper P, the page alignment represents the alignment with regard to the sub-scanning direction (the moving direction of the continuous paper P).

Meanwhile, the alignment with regard to the main scanning direction of the K-color printer 150K is performed as follows. That is, when the color resist mark of K-color (for example, ROC_K2 in FIG. 5) is formed in the K-color printer 150K, the color resist mark reading unit 39K generates the reading position data of the color resist mark of K-color, and sends the data to the K-color printing controller 90K. The K-color printing controller 90K compares the reading position data of the color resist mark of K-color with the standard position data that is set in advance, and generates the alignment correction data (the main scanning position correction data) with regard to the main scanning direction (the axial direction of the photoconductor drum 31) at the time of forming the image in the K-color image forming controller 90K. That is, the main scanning position correction data is the data that shows the displacement amount from the predetermined standard position of the LED of the LED circuit substrate 62. On the basis of the main scanning position correction data, the temperatures of the LED circuit substrate 62 on the LPH 33 described later are controlled and the length of the LED circuit substrate 62 is adjusted.

Thereby, the alignment of the K-color toner image that is formed in the K-color printer 150K in the main scanning direction (the print width correction) is performed. The same is true in the C-color printer 150C, the M-color printer 150M and the Y-color printer 150Y.

Figure 11:
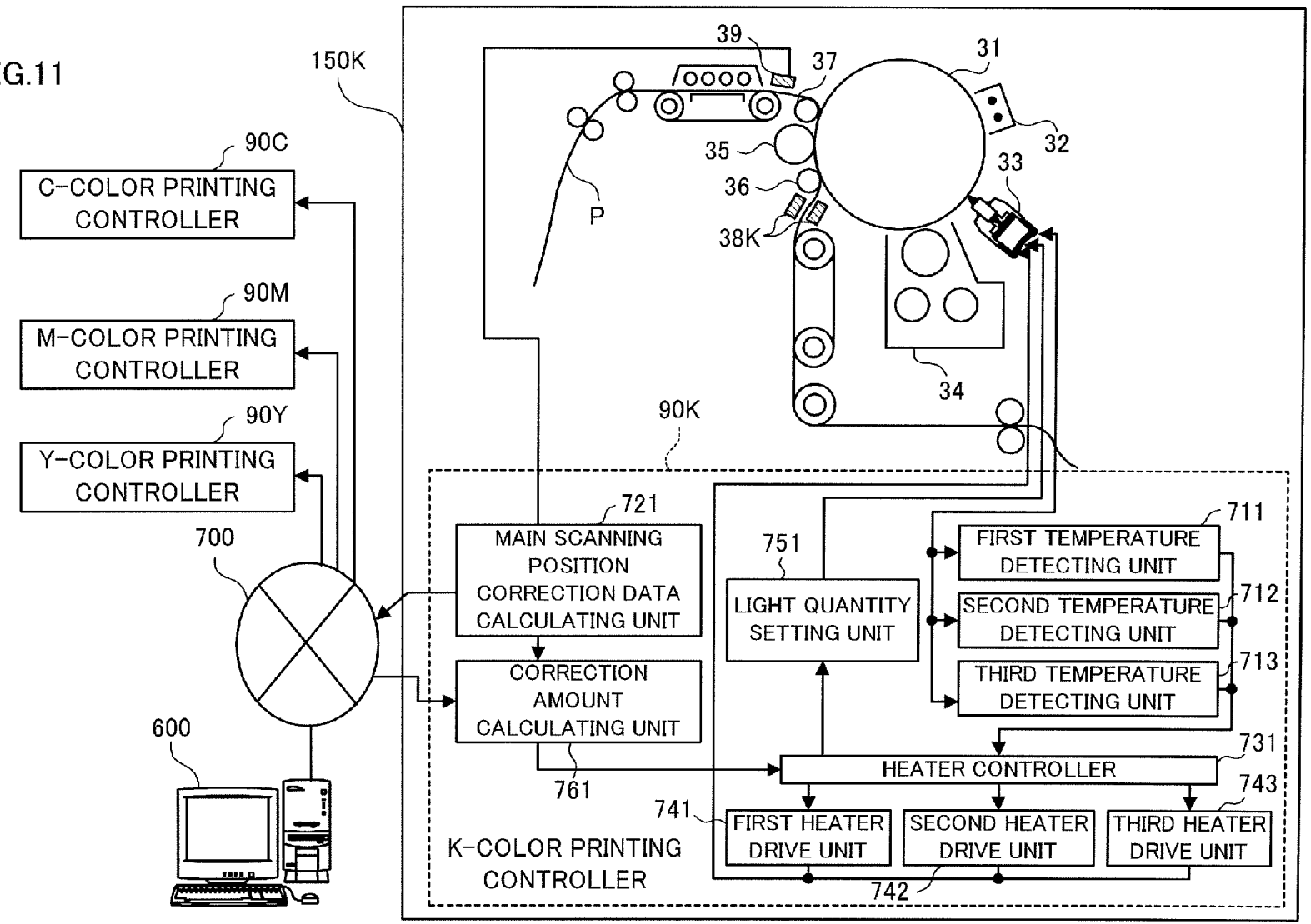
FIG. 11 is a view that explains a function configuring unit that performs the print width correction in the K-color printer according to the second exemplary embodiment.

FIG. 11 is a view that explains a function configuring unit that performs the print width correction in the K-color printer 150K according to the second exemplary embodiment. As shown in FIG. 11, the print width correction is performed under the control of the K-color printing controller 90K.

As the function configuring unit that performs the print width correction, the K-color printing controller 90K is provided with the first temperature detecting unit 711, the second temperature detecting unit 712, the third temperature detecting unit 713, the main scanning position correction data calculating unit 721, the heater controller 731, the first heater drive unit 741, the second heater drive unit 742, the third heater drive unit 743, and a correction amount calculating unit 761. The memory (not shown in the figure) that stores the initial displacement amount of the LED in the main scanning direction for each LPH in the first exemplary embodiment is provided in the control computer 600.

Further, as the function unit that performs setting of the light quantity of the LPH 33 with regard to the print width correction, the K-color printing controller 90K is provided with the light quantity setting unit 751 serving as an example of the light quantity setting unit.

In the K-color printer 150K according to the second exemplary embodiment, the print width correction is performed as follows.

Firstly, the first temperature detecting unit 711, the second temperature detecting unit 712 and the third temperature detecting unit 713 acquire the measured temperature values from the temperature sensor 107A, the temperature sensor 107B and the temperature sensor 107C. The temperature data of the areas is generated from the acquired measured temperature values and sent to the heater controller 731.

The main scanning position correction data calculating unit 721 generates the main scanning position correction data on the basis of the reading position data of the color resist mark of K-color (for example, ROC_K2 in FIG. 5) that is acquired from the color resist mark reading unit 39K, and sends the main scanning position correction data to the control computer 600 and the correction amount calculating unit 761. The main scanning position correction data is sent to the control computer 600 through the communication network 700.

The control computer 600 acquires the main scanning position correction data from the respective color printers 150. The control computer 600 extracts the LPH 33 with, for example, the largest initial displacement amount among the LPHs 33 of the color printers 150 from the initial displacement amounts of LPHs 33 that are stored in the memory. On the basis of the main scanning position correction data in the extracted LPH 33 with the largest initial displacement amount, a reference value serving as the basis of the alignment in the main scanning direction is set. That is, the displacement amount from the standard position with regard to the LPH 33 with the largest displacement amount serves as the basis. The control computer 600 sends the set reference value to the correction amount calculating unit 761 of the color printer 150.

The correction amount calculating unit 761 calculates a difference between the main scanning position correction data that is acquired from the main scanning position correction data calculating unit 721 and the reference value that is acquired from the control computer 600. The correction amount calculating unit 761 sends the calculated difference to the heater controller 731 as the correction amount.

On the basis of the temperature data that is acquired from the first temperature detecting unit 711, the second temperature detecting unit 712 and the third temperature detecting unit 713 and the correction amount data that is acquired from the correction amount calculating unit 761, the heater controller 731 sets the supplying amount of electric power to the three sheet shape heaters 108A, 108B and 108C. That is, the heater controller 731 stores the correspondence relationship between the substrate temperature in the LPH 33 and the position changing amount of the LED in, for example, the ROM or the like (not shown in the figure) serving as an example of the memory, as the table. For example, from the size of the LED circuit substrate 62 in the longitudinal direction and the thermal expansion rate of the material that forms the LED circuit substrate 62, the correspondence relationship between the substrate temperature of the LPH 33 and the position changing amount of the LED is determined. With using the table, the target temperature values for respective areas are set from the temperature data of the areas and the correction amount, and the supplying amount of electric power to the respective sheet shape heaters 108A, 108B and 108C that adjust the temperatures of the areas to the set target temperature values is set.

The heater controller 731 sends the set supplying amount of electric power to the sheet shape heaters 108A, 108B and 108C to the first heater drive unit 741, the second heater drive unit 742 and the third heater drive unit 743 respectively. The first heater drive unit 741, the second heater drive unit 742 and the third heater drive unit 743 drive the sheet shape heaters 108A, 108B and 108C respectively with the set supplying amount of electric power.

In each LPH 33 according to the second exemplary embodiment, along the arrangement direction of the SLEDs 63, the three temperature sensors 107A, 107B and 107C and the three sheet shape heaters 108A, 108B and 108C are also arranged at positions corresponding to each other on the surface and the back surface respectively, and the temperatures of the LED circuit substrate 62 are controlled for each of the areas. Thereby, the alignment of the LEDs between each of the LPHs 33 is performed.

As well as the first exemplary embodiment, corresponding to the temperatures that are set for each of the areas of each LPH 33, the light emitting amount of the LED is adjusted for each of the areas.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An exposure apparatus comprising:

a plurality of light emitting elements that are arranged in a line;

a substrate that the plurality of light emitting elements are arranged thereon;

a plurality of temperature measuring units that are arranged along the arrangement direction of the plurality of light emitting elements and measure temperatures of the substrate on which the plurality of light emitting elements are arranged;

a plurality of heating units that are arranged along the arrangement direction of the plurality of light emitting elements and heat the substrate on the basis of the temperatures measured by the temperature measuring units respectively; and a controller that controls heating values of the plurality of heating units respectively on the basis of the temperatures of the substrate measured by the plurality of temperature measuring units respectively, wherein the controller has a memory that stores a relationship between the temperatures of the substrate and a position change amount of the light emitting elements, and the controller controls the heating value of each of the plurality of heating units by use of the relationship stored in the memory.

2. The exposure apparatus according to claim 1, wherein the plurality of temperature measuring units are arranged on a first surface of the substrate on which the plurality of light emitting elements are arranged, and the plurality of heating units are arranged on positions of a second surface corresponding to where the plurality of temperature measuring units are arranged, the second surface being on the opposite side of the first surface of the substrate.

3. The exposure apparatus according to claim 1, wherein the plurality of temperature measuring units measure the temperatures in different areas on the substrate in the arrangement direction of the light emitting elements respectively.

4. The exposure apparatus according to claim 1, wherein heating values of the plurality of heating units are controlled respectively so that a temperature difference between the temperatures respectively measured in the plurality of temperature measuring units becomes smaller.

5. An image forming apparatus comprising:

a plurality of image carriers;

a plurality of light emitting elements that are arranged corresponding to the plurality of image carriers respectively in a line for exposing the image carriers;

a substrate that the plurality of light emitting elements are arranged thereon;

a plurality of temperature measuring units that measure temperatures of the substrate along the arrangement direction of the plurality of light emitting elements;

a plurality of heating units that heat the substrate along the arrangement direction of the plurality of light emitting elements;

an exposure position detecting unit that detects exposure positions on the image carriers exposed by the plurality of light emitting elements; and a controller that controls heating values of the plurality of heating units respectively on the basis of the temperatures of the substrate measured by the plurality of temperature measuring units respectively and the exposure positions detected by the exposure position detecting unit, wherein the controller has a memory that stores a relationship between the temperatures of the substrate and a position change amount of the light emitting elements, and the controller controls the heating value of each of the plurality of heating units by use of the relationship stored in the memory.

6. The image forming apparatus according to claim 5, further comprising a light quantity setting unit that sets a light emitting amount of the light emitting elements on the basis of the temperatures measured by the plurality of temperature measuring units respectively.

7. The image forming apparatus according to claim 6, wherein the light quantity setting unit sets the light emitting amount of the light emitting elements for each of areas where the plurality of heating units are arranged respectively.

8. The image forming apparatus according to claim 5, wherein the plurality of temperature measuring units are arranged on a first surface of the substrate on which the plurality of light emitting elements are arranged, and the plurality of heating units are arranged on positions of a second surface corresponding to the place that the plurality of temperature measuring units are arranged thereon, the second surface being on the opposite side of the first surface of the substrate.

9. The image forming apparatus according to claim 5, wherein the temperature measuring units are arranged at equal intervals on the substrate.

10. A heat adjustment method comprising:

measuring temperatures of a substrate on which a plurality of light emitting elements are arranged in a line, at a plurality of measuring points corresponding to the plurality of light emitting elements;

heating the substrate by respectively controlling the amount of heating at a plurality of heating points corresponding to the plurality of light emitting elements so that a temperature difference between the temperatures measured at the plurality of measuring points becomes smaller; and controlling heating values at the plurality of heating points respectively on the basis of the temperatures of the substrate measured at the plurality of measuring points respectively, wherein a relationship between the temperatures of the substrate and a position change amount of the light emitting elements is stored, and the heating value at the plurality of heating points is controlled by use of the relationship.

11. The heat adjustment method according to claim 10, wherein the measuring points are located at equal intervals on the substrate.

* * * * *